US008967408B2

(12) United States Patent
Tyberghein

(10) Patent No.: US 8,967,408 B2
(45) Date of Patent: Mar. 3, 2015

(54) PLASTIC FOOD CONTAINER WITH SECURABLE INNER VESSEL

(71) Applicant: Anchor Packaging, Inc., St. Louis, MO (US)

(72) Inventor: Michael Tyberghein, Roswell, GA (US)

(73) Assignee: Anchor Packaging, Inc., Ballwin, MO (US)

( * ) Notice: Subject to any disclaimer, the term of this patent is extended or adjusted under 35 U.S.C. 154(b) by 0 days.

(21) Appl. No.: 13/732,976

(22) Filed: Jan. 2, 2013

(65) Prior Publication Data

US 2014/0183190 A1 Jul. 3, 2014

(51) Int. Cl.

| | |
|---|---|
| ***B65D 21/02*** | (2006.01) |
| ***B65D 1/24*** | (2006.01) |
| ***B65D 85/72*** | (2006.01) |
| ***B65D 81/32*** | (2006.01) |
| ***A45C 11/20*** | (2006.01) |
| ***B65D 25/10*** | (2006.01) |
| ***B65D 77/04*** | (2006.01) |
| ***B65D 43/02*** | (2006.01) |
| ***B65D 51/16*** | (2006.01) |

(52) U.S. Cl.

CPC ..... *B65D 25/10* (2013.01); *B65D 77/048* (2013.01); *B65D 43/0218* (2013.01); *B65D 51/16* (2013.01)

USPC ..... 220/23.89; 220/521; 220/522; 206/541; 206/514; 426/119; 426/115; 426/120

(58) Field of Classification Search

USPC ..... 220/23.89, 521, 522, 527, 528; 426/119, 124, 112, 114, 115, 120; 206/546, 541, 514

See application file for complete search history.

(56) References Cited

U.S. PATENT DOCUMENTS

| | | | | | |
|---|---|---|---|---|---|
| 1,872,864 | A * | 8/1932 | Yarcho | 206/430 |
| 2,935,222 | A * | 5/1960 | O'Connell | 220/509 |
| 5,344,024 | A * | 9/1994 | Cohu | 206/526 |
| 5,377,860 | A * | 1/1995 | Littlejohn et al. | 220/790 |
| 6,376,803 | B1 * | 4/2002 | Klinger | 219/387 |
| 7,326,428 | B2 * | 2/2008 | Weir | 426/120 |
| 2004/0035867 | A1 * | 2/2004 | Schultz et al. | 220/212 |
| 2006/0201950 | A1 * | 9/2006 | Liu | 220/526 |
| 2013/0008897 | A1 * | 1/2013 | Rusnak et al. | 220/23.89 |

* cited by examiner

*Primary Examiner* — Fenn Mathew
*Assistant Examiner* — Jennifer Castriotta
(74) *Attorney, Agent, or Firm* — Don V. Kelly; Evans & Dixon, LLC

(57) ABSTRACT

A food container system for a take-out main course food item includes a plastic lid adapted for sealing arrangement with a plastic base and one or more securable inner vessels adapted to hold an accessory food item. The floor of the base includes one or more first vessel-receiving mechanisms designed to locate and receive the bottom of a securable inner vessel. The lid includes one or more second vessel-receiving mechanisms, each designed to receive and engage the top rim of a securable inner vessel when such vessel is received by a first vessel-receiving mechanism and the lid and base are in the sealed arrangement. The engagement of the top rim of a vessel by a second vessel-receiving mechanism of the lid results in a leak resistant seal between the vessel and the lid.

12 Claims, 13 Drawing Sheets

PLASTIC FOOD CONTAINER WITH SECURABLE INNER VESSEL

CROSS REFERENCE TO RELATED APPLICATION

Not applicable.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to plastic food containers. The invention is more specifically related to disposable plastic food containers designed to hold a main course food item that is accompanied by an accessory food item such as a side dish, sauce or condiment.

BACKGROUND OF THE INVENTION

It is known to use disposable plastic containers in the food preparation and restaurant industry to package prepared or take-out foods. The typical food container of the prior art consists of a clear or opaque color base and a clear or opaque lid. The clear lid of the prior art plastic food container allows visible inspection of the container contents. The lid and base of the prior art plastic food container may be separate articles or may be attached to each other via a hinge.

The lid and base of the prior art plastic container have complementary interlocking rim structures that seal the container. This interlocking rim arrangement is beneficial in helping keep cooked foods warm and in preventing spillage of food contents from the container. Main course take-out food items typically include a side dish, sauce or condiment. For example, when waffles or pancakes are ordered, the food establishment will include butter and syrup with the order. Likewise, when chicken strips are ordered, the food establishment will typically include a dipping sauce of the customer's choice with the order. In some cases, the main course item is intended to be sold and eaten with a side dish. For example, a chicken breast entree may include a side order of french fries, mashed potatoes, cole slaw or some type of salad.

When these types of foods are purchased for take-out, it is intended that the customer will eat the purchased food at some length of time after purchase. Hence, if a sauce or condiment is added to the main course item prior to or at the time of delivery of the food, the main course food item may degrade in texture and appeal by the time the customer is ready to eat the purchased item. The likewise can happen to both the main course item and side dish if they are placed in the same container and are caused to come in contact with each other or mix with each other.

To avoid the food degradation issue, the typical prior art take-out food establishment will provide any accompanying sauce, condiment or side dish in a separately sealed container that comprises a base component (a cup, bowl or tray) and a lid. Alternatively, in the case of a sauce or condiment, the sauce or condiment may be provided in the form of a pouch or packet. There are drawbacks associated with utilizing these separately sealed containers. Purchasing and providing these additional separately sealed containers increases the overhead cost of the food establishment. This cost is typically borne by the customer in the form of added food prices. In addition, the food establishment must dedicate storage space for the separate containers (base components and lids), pouches and packets. If the food handed to the customer is aggregated in a bag, the employee filling the order must make sure each separately sealed container is included in the bag that is given to the customer. As any person who has ever patronized a fast-food restaurant knows, it is not uncommon for take-out customers to be shorted one or more of their accessory food items.

In the case where the take-out food items are not given to the customer aggregated in a bag, the customer buying the main course item must now carry at least one additional container when taking away the purchased food item. Not only is this cumbersome for the customer, from an environmental standpoint, serving a main course food item with a separately sealed accessory food item doubles the amount of throw-away waste articles aggregating in landfills. Hence, using separately sealed containers and pouches to provide accessory food items for take-out purposes, is environmentally unfriendly.

The prior art attempts to deal with the drawbacks attendant to using separately sealed containers and pouches for accessory food items through the use of compartmentalized food containers. With these containers, the base component usually has one main compartment and one to two additional compartments for side dishes. One problem with the prior art compartmentalized container is that it is always compartmentalized and cannot be used for over-sized main dishes that do not need accessory food items. More problematic is the fact that the compartments are not leak-resistant, so even minor jostling of the container results in the contents of the compartments sloshing together.

There is thus a need in the art for an improved plastic food container that provides containment for take-out main course dishes, reduces the need to for secondary sealed containers for accessory food items and eliminates the lack of flexibility and lack of leak-resistance associated with known compartmentalized food containers.

SUMMARY OF THE INVENTION

The present invention satisfies the need in the art and provides an aesthetically appealing plastic food container that is easy to use, while providing for unitary carriage of both main course and accessory food items in a manner that will not degrade either the main course or the accessory food items. The present invention food container comprises a plastic container, comprising a lid and a base, that is adapted to secure at least one separate vessel inside the container. Unlike the prior art compartmentalized containers, the invention provides the flexibility to include a condiment or side dish in the container or allow the container to remain as a large unobstructed single cell for large food items. The invention also allows a side dish to be pre-packaged and held either hot or under refrigeration, until time of sale, and then added in a modular fashion, thereby creating a cost-efficient compartment instantly. Upon opening a filled container having an accessory food item in the vessel, the vessel (along with its contained contents) can be removed non-destructively out of the base of the container.

The base of the present invention container may be any food holding vessel, including but not limited to a plate, a tray, bowl or casserole dish. The base has a floor, a base sidewall and a base rim formed atop the base sidewall. The lid of the present invention container has an upper portion, a lid sidewall and a lid rim formed at the bottom of the lid sidewall. The lid rim is adapted for sealing engagement with the base rim. The container also includes the separate vessel intended for securement inside the container.

To achieve securement, the floor of the base has a first vessel-receiving mechanism formed therein. The first vessel-receiving mechanism formed in the base floor is sized and shaped to receive the bottom of the securable vessel that will be housed and secured within the interior of the container when the lid and base are in sealed engagement. In the event the container is needed to package a large main food course item, the securable inner vessel can be dispensed with and the container can be used as a standard, one-compartment container.

To complete securement of the vessel inside the sealed lid and base of the container, the first vessel-receiving mechanism formed in the base floor has a counterpart second vessel-receiving mechanism formed in the upper portion of the lid. The second vessel-receiving mechanism is sized and shaped to receive the top rim of the securable inner vessel when the securable vessel is located in the first vessel-receiving mechanism and the lid and base are in sealed engagement. With the securable vessel received by the first vessel-receiving mechanism, the lid and base can be sealingly engaged, thereby causing the second-vessel receiving mechanism in the lid to receive the top rim of the vessel. The first vessel-receiving mechanism and the second vessel-receiving mechanism restrain the securable vessel from lateral and vertical movement within the sealed container. Additionally, the action of the first and second vessel-receiving mechanisms on the vessel creates a leak resistant seal between the top rim of the vessel and the second vessel-receiving mechanism.

The invention is further directed to a container system that includes the specially adapted plastic container and the one or more securable inner vessels. The preferred embodiment securable vessel is a cup, but it may also be a bowl, mug or any other holding vessel. In a more specific preferred embodiment, the securable inner vessel is a paper cup and the first vessel-receiving mechanisms is an impressed rib forming a ring-shaped trough in the inner surface of the floor of the base. The ring-shaped trough is further shaped to receive structure descending from the floor of the cup, such as the bottom rim at the portion of the sidewall that is located below the floor of a paper cup.

In the preferred embodiment described immediately above, the second vessel-receiving mechanism is also an impressed rib forming a ring-shaped trough in the inner surface of the lid upper portion and sized and shaped to receive the top rim of the vessel.

In one embodiment the lid is vented. In this respect the container lid may contain vents known in the prior art, which can be located over the portion of the container reserved for the main food item course and the portion of the container in which a vessel is secured. In the latter respect, the lid over the securable inner vessel is vented. The container lid and base can be two separate articles or can be conjoined on a unitary structure via a hinge. In varying embodiments wherein the vessel is a cup, the cup may be formed of paper, plastic or any other material.

DETAILED DESCRIPTION

Figure 1:
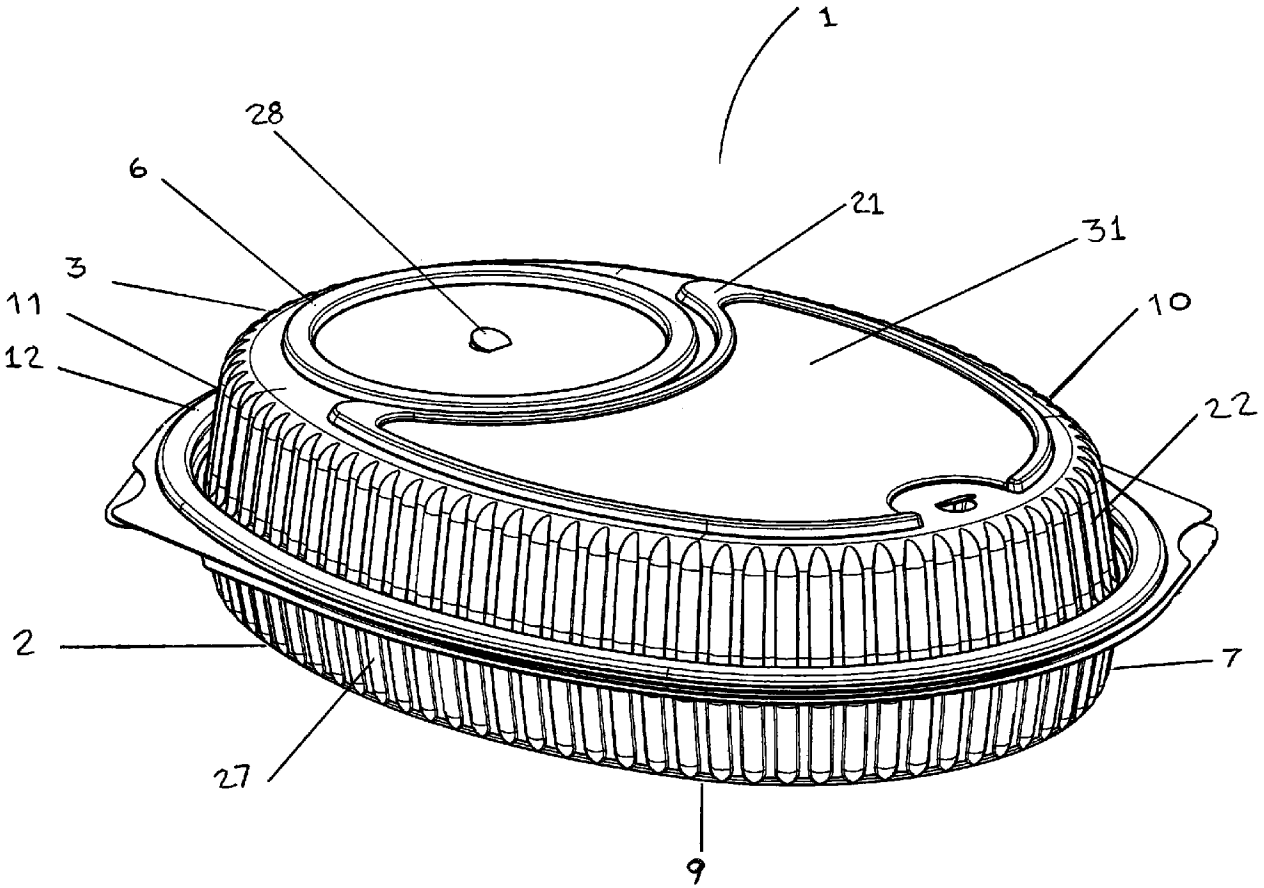
FIG. 1 is a front perspective view of a preferred embodiment of the present invention plastic container in the sealed state in which it is capable of securing a separate inner vessel. The shown embodiment container includes a lid that is sealingly engaged to a base and is adapted to secure a single inner vessel in the form of a cup.

The present invention is directed to both a container and a system using the container. The container includes one or more vessel-receiving mechanisms on the lid and base to restrain one or more innerly securable vessels. The present invention container thus comprises at least one first vessel-receiving mechanism situated on the floor of the base and at least one counterpart vessel-receiving mechanism located on the lid of the container. Each second vessel-receiving mechanism is preferably, but not necessarily, located opposingly (perpendicularly above) the first vessel-receiving mechanism when the lid and tray are sealingly engaged. The accompanying figures depict the invention in its preferred embodiment form with only a single securable vessel for clarity purposes. Hence, the accompanying figures are not intended to be limiting, but are intended to more clearly show the overall invention.

A preferred embodiment plastic container 1 of the present invention in the sealed arrangement is shown in FIGS. 1, 3, 4 and 9-12. The container is preferably thermoformed. As shown by these figures, container 1 comprises a base (main food item holding vessel) 2 and lid 3 to secure one or more inner vessels 4. In the disclosed embodiment, base 2 is a tray. Base 2 may be clear or opaque. Lid 3 can be clear or opaque and includes upper portion 10, descending peripheral sidewall 11 and multi-segment peripheral rim 12. Lid 3 and base 2 are manufactured from a conventional plastic material. Upper portion 10 is preferably flat, but can be curved or domed and have one or more upper portion ribs 21 in accordance with the prior art to enhance such factors as container volume, strength, nesting of multiple lids, stackability of sealed containers and see-through visibility. In the preferred embodiment lid upper portion 10 includes plateau 31. Lid 3 includes sidewall 11. Sidewall 11 extends from upper portion 10 to lid rim 12. Sidewall 11 preferably includes ribs 22 for strength and appearance.

The structure of preferred embodiment base 2 is best shown in FIGS. 5, 6, 7, 8, and 13. Base 2 includes a floor 9 adjoined to peripheral sidewall 7. Sidewall 7 extends between floor 9 and peripheral multi-segment rim 8. Sidewall 7 preferably includes ribs 27 for strength. The structure of base rim 8 is adapted to complementarily and sealingly engage the structure of lid rim 12 when lid 3 and base 2 are placed in sealing arrangement.

Figure 2:
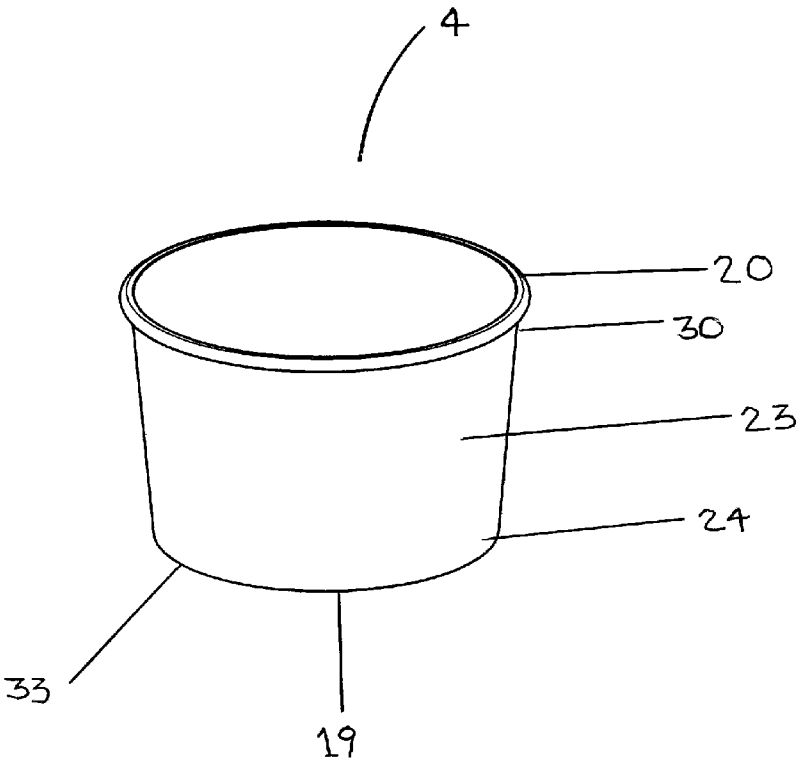
FIG. 2 is a front perspective view of a cup, which is the preferred embodiment separate securable inner vessel for the preferred embodiment plastic container shown in the figures.
Figure 3:
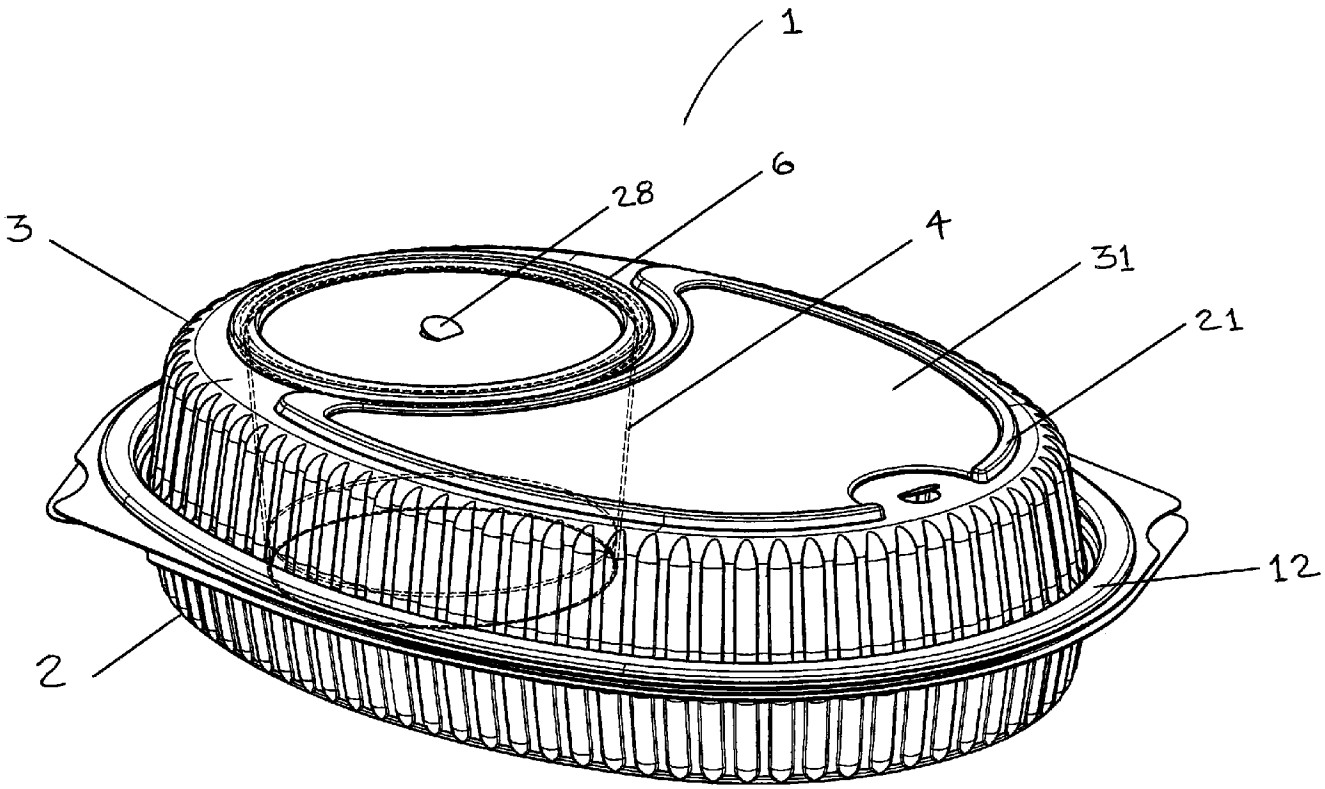
FIG. 3 is a front perspective view of a preferred embodiment of the present invention plastic container in sealed arrangement with the securable inner vessel in its secured position. The secured vessel is shown in phantom, broken-line format. The bottom of the vessel is received by the first vessel-receiving mechanism located in the floor of the base and the top rim of the vessel is engaged by a preferred embodiment, second vessel-receiving mechanism in the lid.
Figure 4:
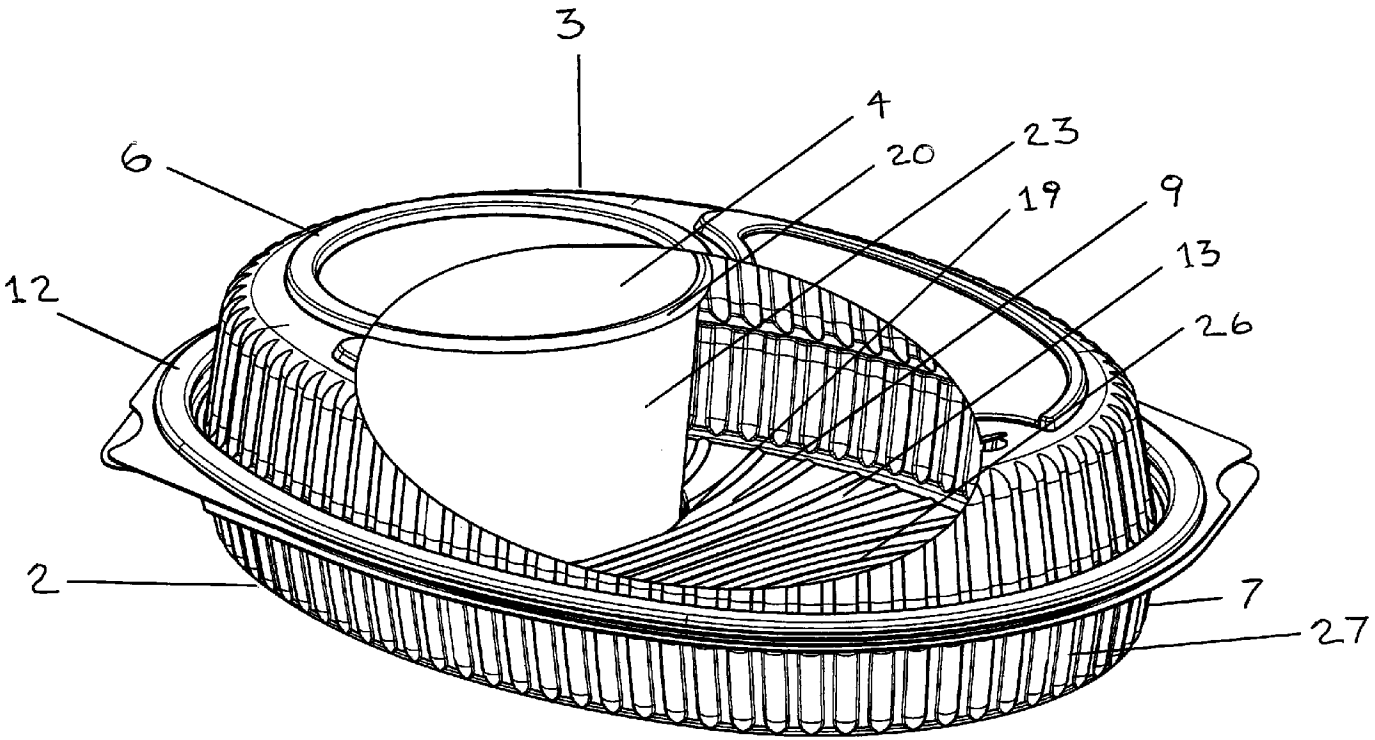
FIG. 4 is a front perspective, cut-away view of a preferred embodiment of the present invention plastic container in sealed arrangement with the securable inner vessel (cup) in its secured position. The cut-away detail shows the bottom rim of the cup seated in a preferred embodiment, first vessel-receiving mechanism located in the floor of the base and with the top cup rim engaged by a preferred embodiment, second vessel-receiving mechanism in the lid.
Figure 5:
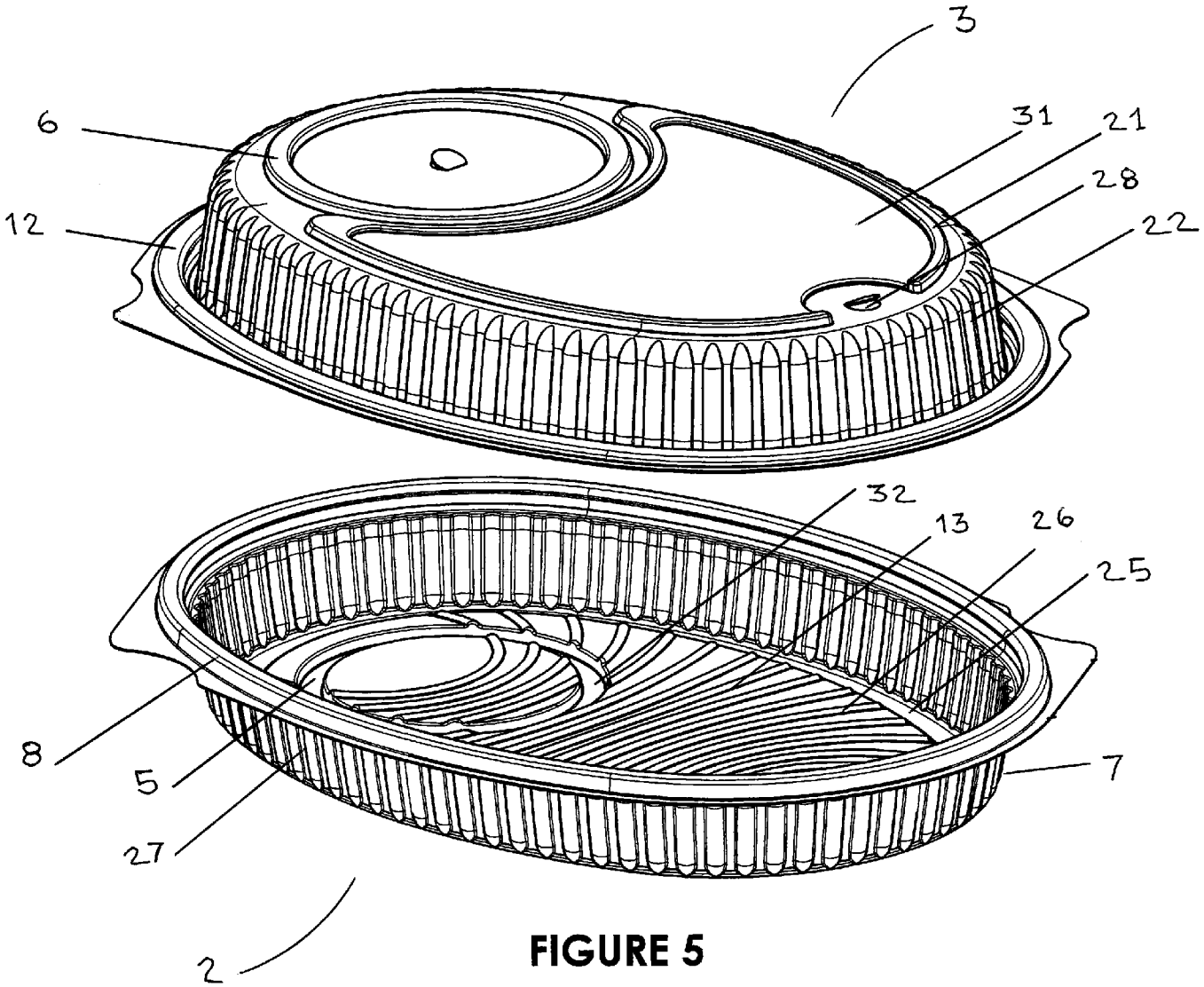
FIG. 5 is an exploded front perspective view of the lid and base of a preferred embodiment of the present invention plastic container with the preferred embodiment securable inner vessel removed.
Figure 6:
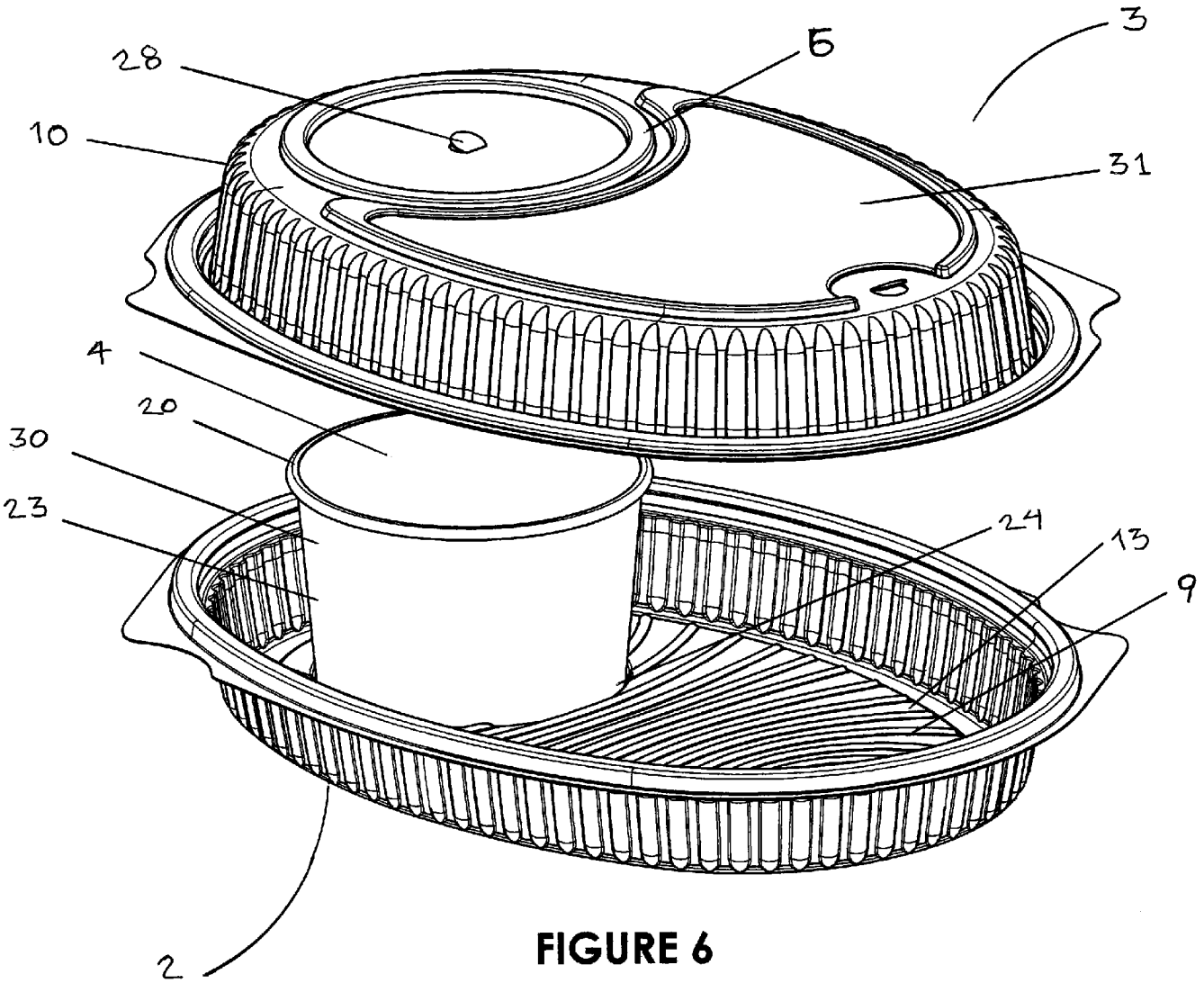
FIG. 6 is an exploded front perspective view of a preferred embodiment container system that includes a preferred embodiment plastic container (lid and base) and the preferred embodiment securable inner vessel nested in a preferred embodiment, first vessel-receiving mechanism in the floor of the base.
Figure 7:
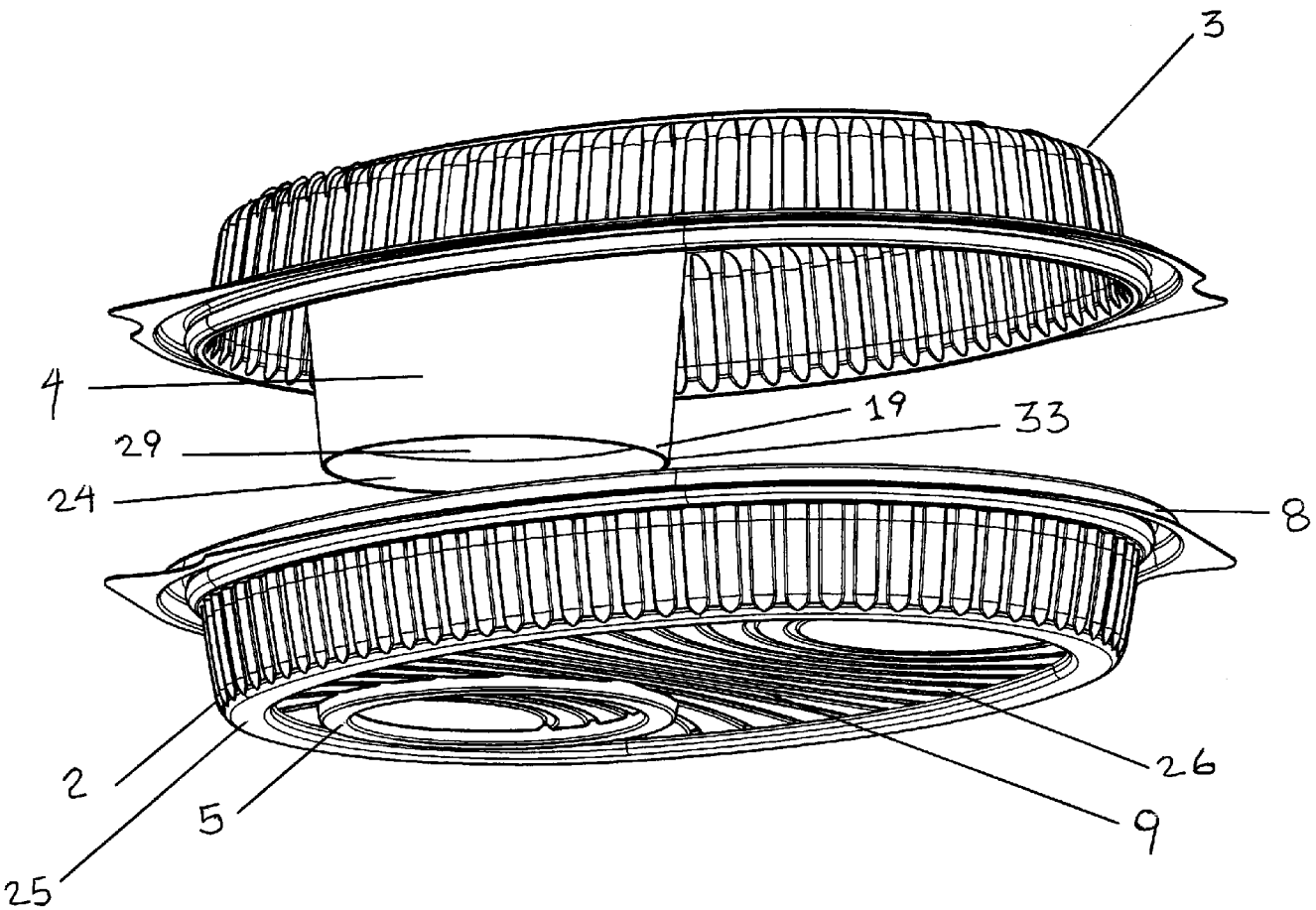
FIG. 7 is an exploded front, upwardly-looking perspective view of the lid and base of a preferred embodiment of the present invention plastic container showing the features of the floor of the base, including the first vessel-receiving mechanism. In the drawing, the preferred embodiment securable inner vessel is received by the second vessel-receiving mechanism in the upper portion of the lid.
Figure 8:
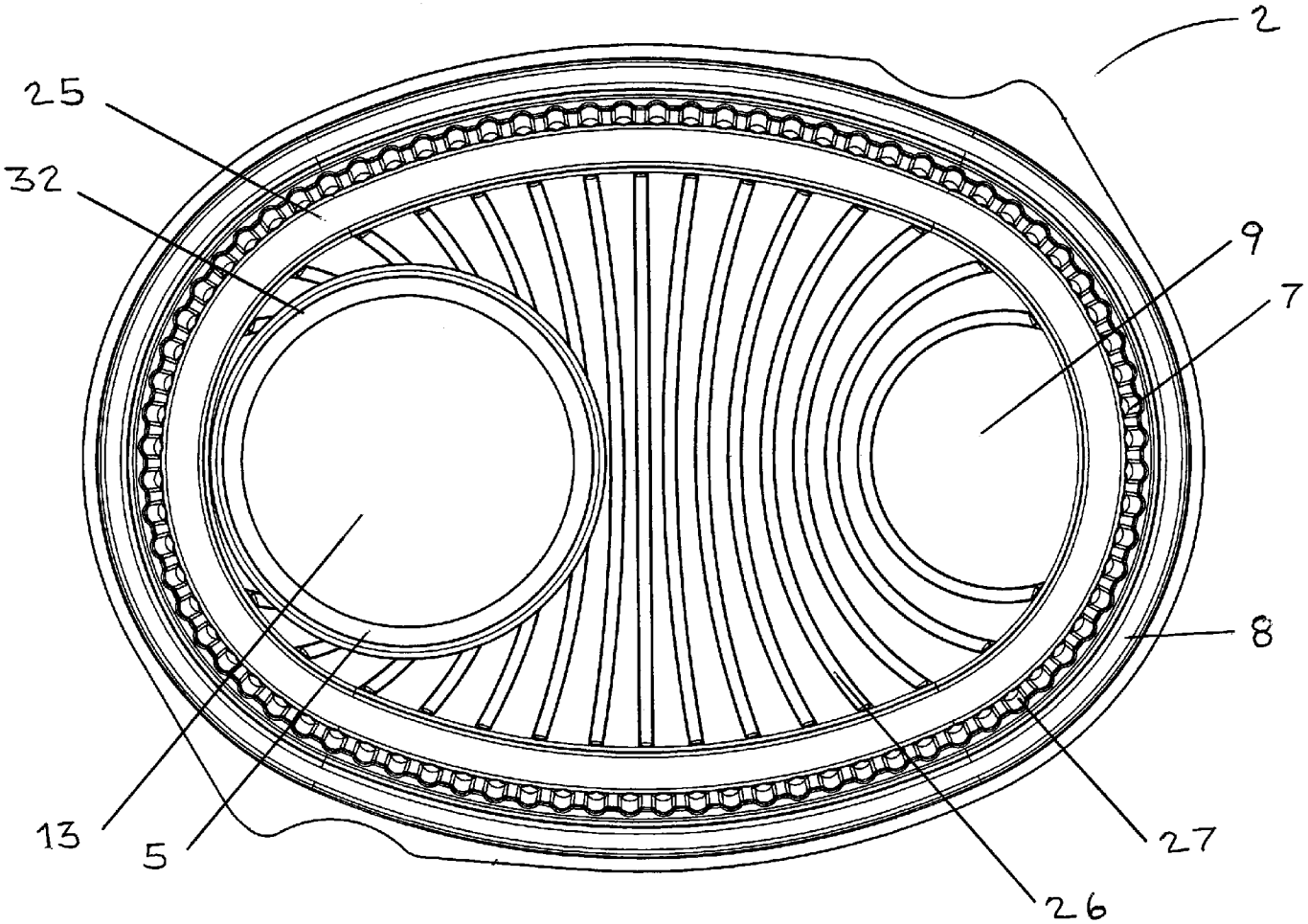
FIG. 8 is a top plan view of the preferred embodiment base showing the inner surface of the floor of the base and the first vessel-receiving mechanism.
Figure 9:
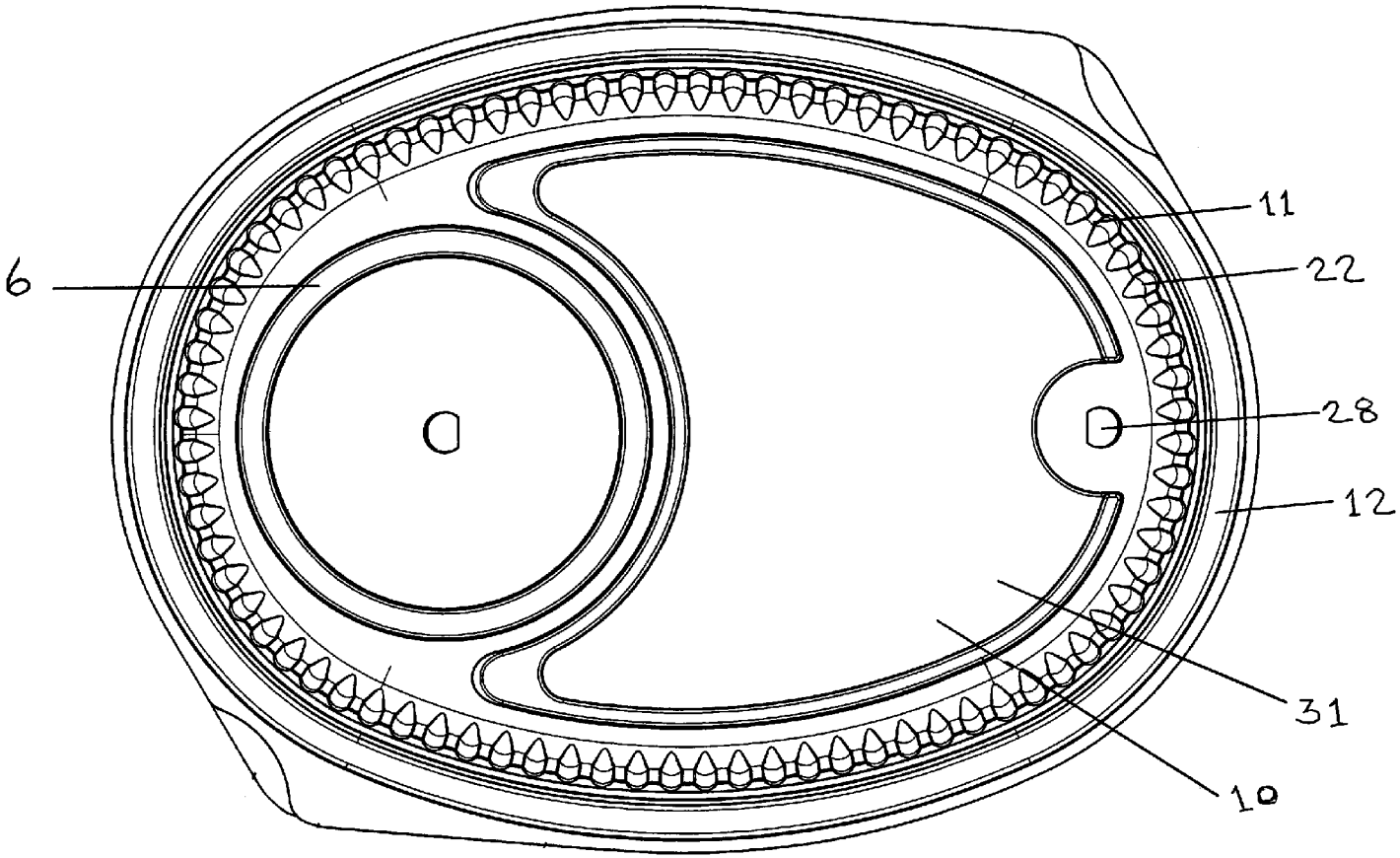
FIG. 9 is a top plan view of the preferred embodiment container in sealed arrangement and showing the outer surface of the upper portion of a preferred embodiment lid, the ring-shaped feature being a preferred embodiment second vessel-receiving mechanism.
Figure 10:
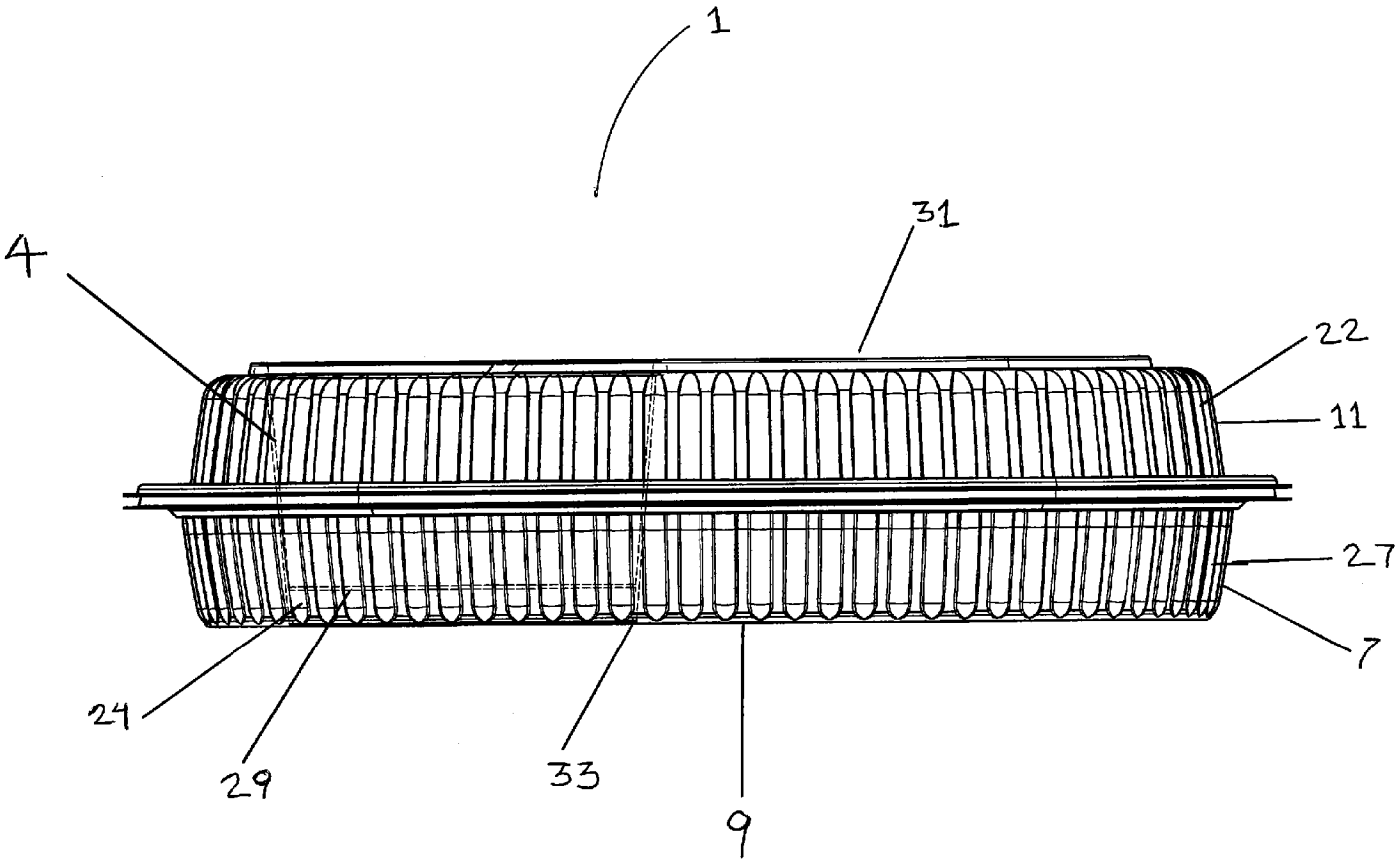
FIG. 10 is a front elevation view of the preferred embodiment container system showing the base and lid sealingly engaged and the secured inner vessel shown in phantom, broken line format.
Figure 11:
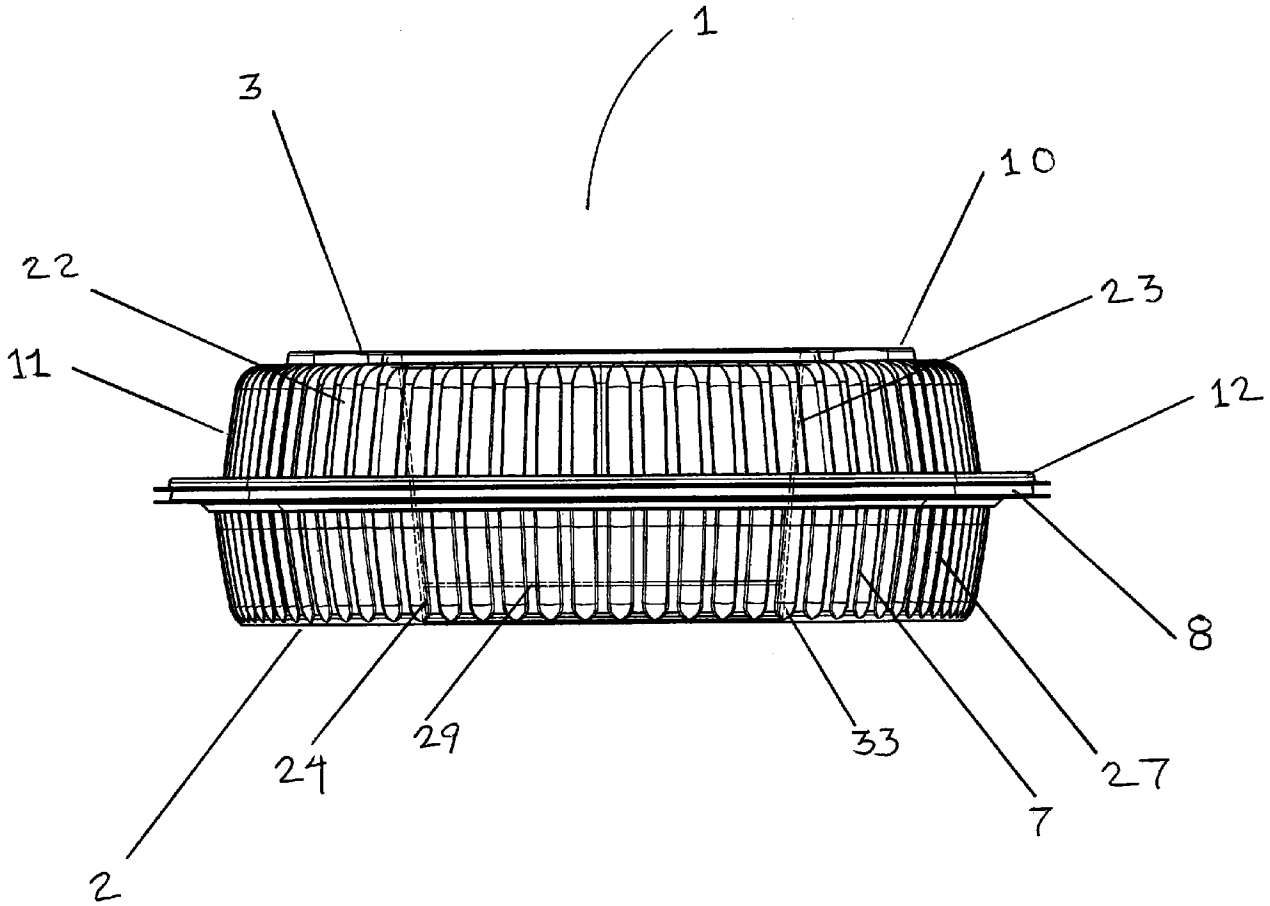
FIG. 11 is a left elevation view of the preferred embodiment container system showing the base and lid sealingly engaged and the secured inner vessel shown in phantom, broken line format.
Figure 12:
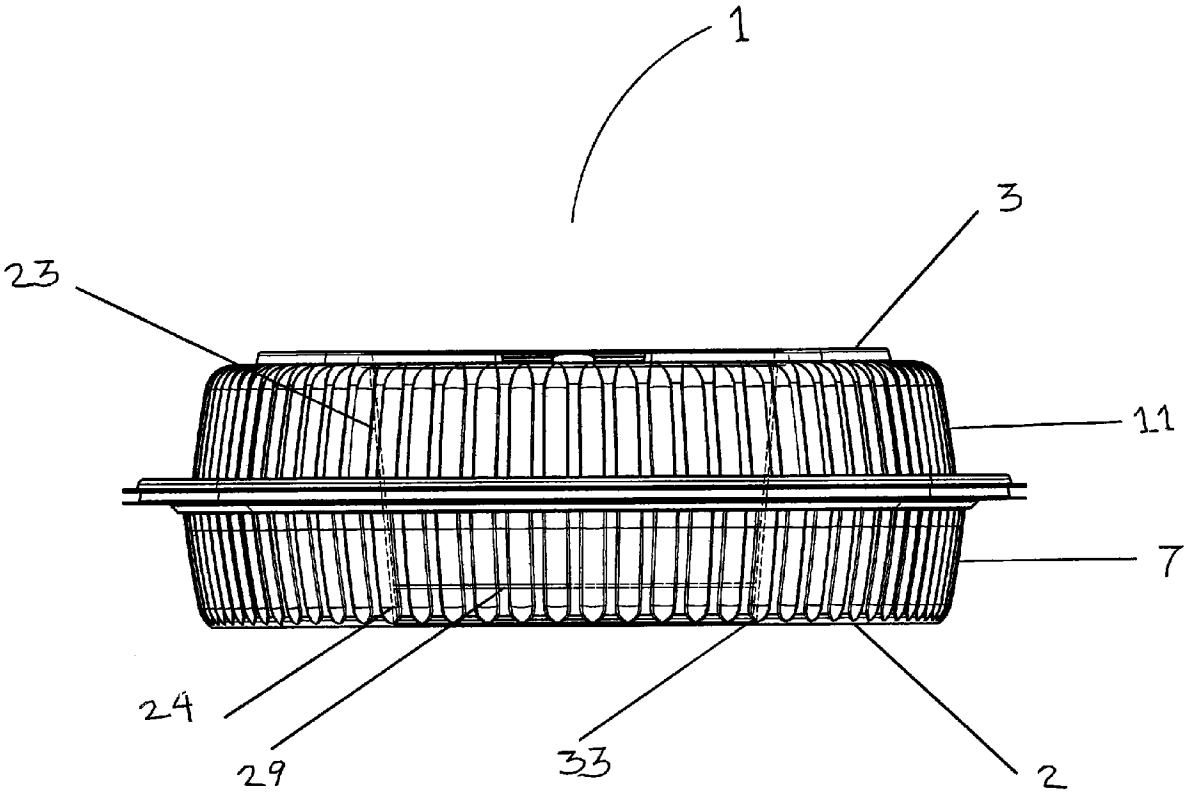
FIG. 12 is a right elevation view of the preferred embodiment container system showing the base and lid sealingly engaged and the secured inner vessel shown in phantom, broken line format.
Figure 13:
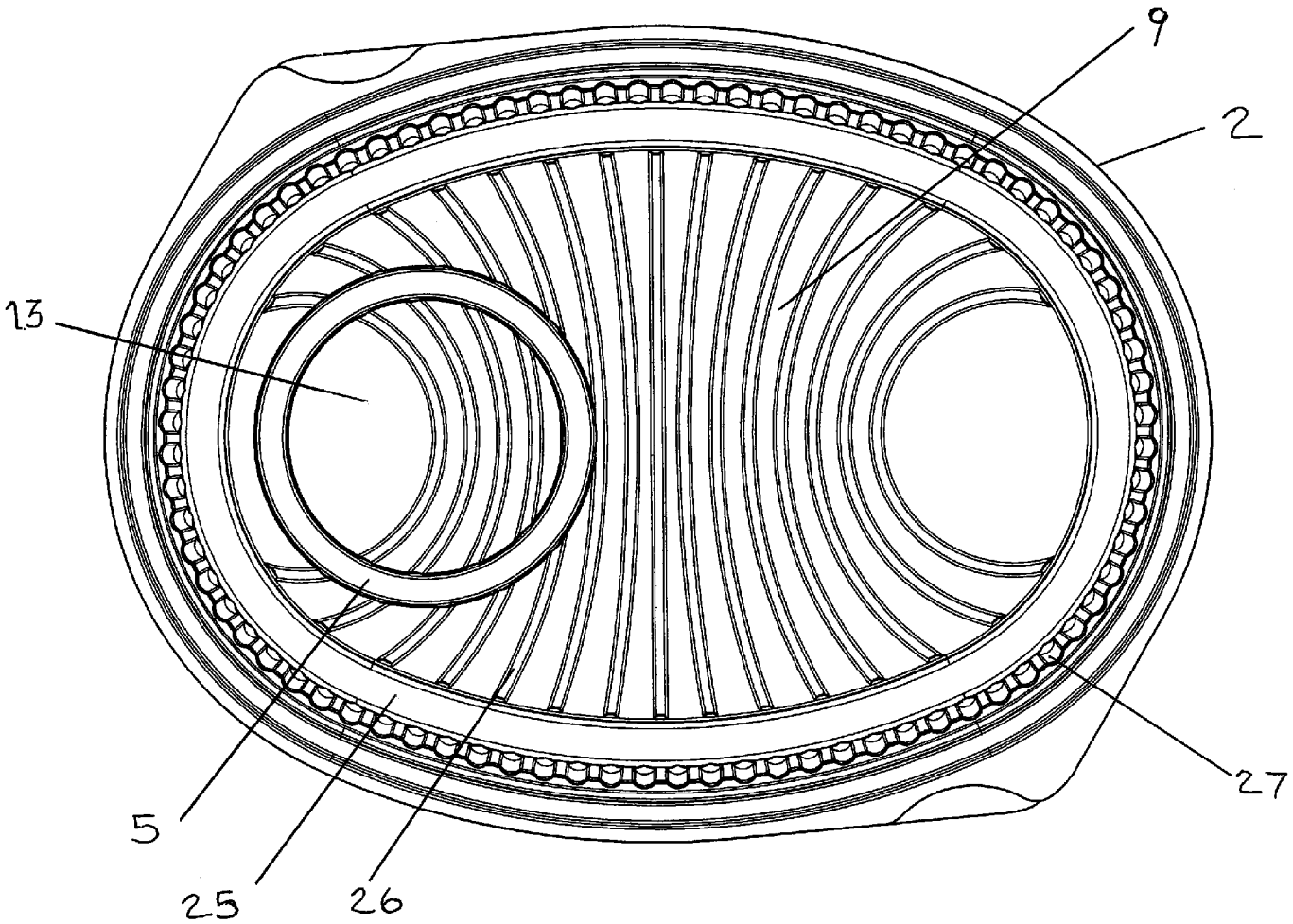
FIG. 13 is a bottom plan view of the preferred embodiment container showing the detail of the floor of the base and the first vessel-receiving mechanism. The lid and base are sealingly engaged in the figure.

The container is adapted to restrain in its interior a separate, securable inner vessel 4, shown singularly in FIG. 2. The securable inner vessel is a separate item that is not integrally formed as part of either the lid or base. Hence, at the option of the user, securable inner vessel 4 may be placed in container 1 to load accessory food items or not used with container 1. If used, then after opening container 1, vessel 4 may be separately and non-destructively removed from container 1. Inner vessel 4 can be formed of paper, plastic or any other material from which vessels, particularly disposable ones, are made. In the depicted preferred embodiment, vessel 4 is a paper cup. Vessel 4 includes a vessel bottom 19, a vessel sidewall 23, a vessel top rim 20 and vessel top portion 30. In the depicted preferred embodiment paper cup, vessel 4 also includes a raised floor 29 and lower sidewall 24. Lower sidewall 24 is that portion of sidewall 23 that extends beneath floor 29 to bottom 19 of preferred embodiment cup-shaped vessel 4. On the bottom 19 of depicted embodiment paper cup 4 there is a bottom cup rim 33 located at the end of lower sidewall 24.

As seen best in FIGS. 5, 6, 7, 8, and 13, base 2 includes structure formed in or on the inside surface 13 of floor 9. This structure constitutes first vessel-receiving mechanism 5. In the present invention, base floor 9 can have one or more first vessel-receiving mechanisms 5 formed in it. Vessel-receiving mechanism 5 operates to locate and provide a nesting receptacle to receive the bottom 19 of vessel 4.

As is best seen in FIGS. 1, 3, 4, 5, 6 and 9, lid 3 also includes a second vessel-receiving mechanism 6 that is sized and located on lid 3 such that when vessel 4 is situated in first vessel-receiving mechanism 5 and rim 12 of lid 3 is sealingly engaged to rim 8 of base 2, second vessel-receiving mechanism 6 frictionally engages the top rim 20 of vessel 4. Hence, lid 3, tray 2 and vessel 4 of the present invention container are optimally sized in height such when base 2 and lid 3 are sealingly engaged, bottom 19 of vessel 4 and inner surface 13 of floor 9 are in contact at the same time that vessel top rim 20 and lid upper portion 10 are in contact with each other. Further, vessel top rim 20, first vessel-receiving mechanism 5 and second vessel-receiving mechanism 6 are optimally shaped such that the engagement of vessel top rim 20 by second vessel-receiving mechanism 6 provides a leak resistant seal.

In the preferred embodiment wherein the separate, securable inner vessel is a cup, first vessel-receiving mechanism 5 is an impressed rib 32 on inner surface 13 of floor 9. In the preferred embodiment, rib 32 forms a ring-shaped trough in inner surface 13 of floor 9. This trough is complementary in dimension to the circular shape of cup bottom rim 33 located on lower sidewall 24 of cup 4. The trough cross-sectional shape of ring-shaped first vessel-receiving mechanism 5 receives the rim 33 of lower sidewall 24. By being a ring-shaped trough, cup bottom rim 33 may be inserted into first vessel-receiving mechanism 5. When formed in this fashion, first vessel-receiving mechanism 5 acts to prevent both radial inward and outward movement of cup 4.

Vessel-receiving mechanism 5 could, however, be a simple impression, complementarily shaped in accordance with the perimeter footprint of vessel 4. Thus, in one embodiment, first vessel-receiving mechanism 5 is an impressed area formed in the inner (food bearing) surface of the floor of the base and shaped to follow the footprint of the vessel. In another embodiment, first vessel-receiving mechanism 5 is an embossed perimeter rib formed upwardly from the inner surface of the floor and shaped and sized to follow the outer footprint of securable vessel 4 and continuously embrace its bottom 19. In another embodiment, first vessel-receiving mechanism 5 is a plurality of embossments on the inner surface of the tray floor shaped to follow the footprint of securable vessel 4 and discontinuously embrace bottom 19.

In another embodiment, also for use with cups that have the lower sidewall 24 feature depending from a floor 29, first vessel-receiving mechanism 5 could be an embossed (upwardly-directed) protrusion upon which cup 4 is seated. In this embodiment, when cup 4 is seated upon upwardly protruding first vessel-receiving mechanism 5, the mechanism is encapsulated by floor 29 and lower sidewall 24. Specifically, when cup 4 is situated on first vessel-receiving mechanism 5, embossed first vessel-receiving mechanism 5 is located in the space underneath floor 29 of cup 4 and within the circular space defined by lower sidewall 24.

When used by a food establishment to house a main course food item, vessel 4 will normally be loaded with an accessory food item before food is placed in base 2. Once filled, vessel 4 would be placed in first vessel-receiving mechanism 5 in base 2. At this point, base 2 would be filled with a main course food item. Upon placement of filled cup 4 and the main course food item in base 2, container 1 is now in condition to be sealed.

Container 1 with filled vessel 4 nested in vessel-receiving mechanism 5 is sealed by placing lid 3 over tray 2 and snap fitting engageable rims 8, 12. In the shown embodiment, both first vessel-receiving mechanism 5 and second vessel-receiving mechanism 6 are respectively asymmetrically located on base 2 and lid 3. Accordingly, in the depicted asymmetrical embodiment, in order for second vessel-receiving mechanism 6 of lid 3 to properly engage vessel top rim 20, lid 3 must be oriented with tray 2 when engaging lid 3 to tray 2. When oriented properly and sealingly engaged, the inner surface of lid upper portion 10 and vessel top rim 20 form a leak resistant seal. The leak-resistant seal between vessel top rim 20 and second vessel-receiving mechanism 6 reduces spillage of the contents of vessel 4 in the event that filled container 1 is tilted or inverted.

The leak resistant seal between lid upper portion 10 and vessel top rim 20 may be formed simply by the downward pressure of lid upper portion 10 on vessel rim 20 located at the upper portion 30 of securable inner vessel 4. In the disclosed embodiment, second vessel-retaining mechanism 6 is a ring shaped trough impressed in the inner surface (not shown) of upper portion 10 of lid 3. The drawings show the outside surface of lid upper portion 10 and therefore this ring appears as an embossed circular structure on the outer surface of upper portion 10. To provide enhanced leak resistance, this ring-shaped trough is sized to complement the inner and outer dimensions of cup rim 20 and receive cup rim 20 when lid 3 is sealingly engaged to base 2. In still another embodiment, second vessel-retaining mechanism 6 is an embossed ring or protrusion that is sized to complement the inner diameter of cup upper portion 30 and cup rim 20. This embodiment of second vessel-receiving mechanism is designed to provide plug-type leak resistance. In this embodiment when the lid and tray are sealingly engaged, second vessel-receiving mechanism 6 is received by (inserted into) the top of cup and frictionally engages the inner part of sidewall 23 at the upper portion 30 of vessel 4 at the same time upper portion 10 of lid 3 exerts downward pressure on cup rim 20. In this embodiment, second vessel-receiving mechanism 6 acts to plug vessel 4.

In one embodiment, at least one of the second vessel-receiving mechanisms is an impressed area formed in the inner surface of the lid upper portion and sized and shaped to encapsulate the rim of the vessel. In another embodiment, at least one of the second vessel-receiving mechanisms is an embossed perimeter rib formed on the inner surface of the upper portion of the lid with a shape complementary to that of the inner or outer diameter of the rim of the vessel. In another embodiment, at least one of the second vessel-receiving mechanisms is a plurality of embossments on the inner surface of the lid upper portion with a shape complementary to that of the rim of the vessel.

In one embodiment, lid 3 has one or more vents 28 for venting the container and controlling internal moisture levels. The size and number of vents can be varied to accommodate the food heating environment or the requirements of the food placed in the container. The container can be provided with the shown lid vents 28 to further enhance the flow of steam out of the container. In this respect the container lid may contain vents known in the prior art, which are located over the portion of the container reserved for the main food item course and the portion of the container in which a vessel is secured. In the latter respect, the lid over the securable inner vessel is thus vented and allows for hot sauces and side dish items. The container lid and base can be two separate articles or can be conjoined on a unitary structure via a hinge. In varying embodiments wherein the vessel is a cup, the cup may be formed of paper, plastic or any other material.

In the depicted embodiment with tray-shaped base 2, floor 9 preferably includes two or more ribs 26 and may have alternative levels or elevations for strength, gripping of solid food items and fluid control. Floor 9 may also include perimeter rib channel 25, which adds strength and retains liquid away from food items in container. To further enhance strength and appearance of tray-shaped base 2, base 2 comprises sidewall ribs 27, which project upward from floor 9 along tray sidewall 7. Sidewall 11 of lid 3 may also have ribs 22 formed in it.

As noted, lid 3 and base 2 can be formed so as to have retaining mechanisms to restrain one or more securable inner vessels. In this embodiment the food container would comprise a lid and a base, each formed from plastic and adapted to innerly secure one or more vessels as herein described. The base has a floor, a base sidewall and a base rim formed atop the base sidewall. The lid has an upper portion, a lid sidewall and a lid rim formed at the end of the lid sidewall. The lid rim is adapted for sealing engagement with the base rim. Further, the floor has one or more first vessel-receiving mechanisms formed therein for receiving the bottom of each of one or more securable inner vessels. In turn, the lid has one or more second vessel-receiving mechanisms formed therein. Each second vessel-receiving mechanism is sized and shaped to receive the top of one of the one or more securable inner vessels when that vessel that is received by a first vessel-receiving mechanism and when the lid and base are in sealed engagement. When the lid and base are in sealed engagement with each of the securable inner vessels received by a first vessel-receiving mechanism and a second-vessel receiving mechanism, each of the one or more vessels is restrained from lateral and vertical movement within the container. The container system, in turn, would include the one or more securable inner vessels. Each securable inner vessel has a vessel bottom, a vessel sidewall and a vessel top rim.

A lid and base constructed in accordance with the present invention can be manufactured in a variety of shapes and sizes, and is preferably formed of resins or plastic materials including, but not limited to, polyethylene, polypropylene, polyvinyl chloride or polyethylene terephthalate ("PET"). The lid and base are preferably thermoformed. The container lid and base can be transparent or translucent, and may be colored in either instance. Further, the container can be of any shape, including round or polygonal. The lid and base of the container may be separate articles as shown or may include a hinge such that the lid and base are connected to each other in a clamshell configuration.

Having described the invention in detail, those skilled in the art will appreciate that modifications may be made of the invention without departing from its spirit. Therefore, it is not intended that the scope of the invention be limited to the specific embodiment illustrated and described.

What is claimed is:

1. A food container system comprising:

a plastic container, comprising a lid and a base for holding a main course food item;

a vessel, the vessel being separate from both the lid and the base and having a vessel bottom, a vessel sidewall and a vessel top rim;

the base having a floor, a base sidewall and a base rim formed atop the base sidewall;

the lid having an upper portion, a lid sidewall and a lid rim formed at the end of the lid sidewall;

the lid rim adapted for sealing engagement with the base rim;

the base floor having a first vessel-receiving mechanism formed therein, the first vessel-receiving mechanism being sized and shaped to receive the bottom of the vessel;

the lid upper portion having a second vessel-receiving mechanism formed therein, the second vessel-receiving mechanism being sized and shaped to frictionally engage the top rim of the vessel when the vessel is received by the first vessel-receiving mechanism and when the lid and base are in sealed engagement; and when the lid and base are in sealed engagement with the vessel received by the first vessel-receiving mechanism and frictionally engaged by the second-vessel receiving mechanism, the vessel is restrained from lateral and vertical movement within the sealingly engaged lid and base and the upper portion of the lid exerts downward pressure on the vessel rim.

2. The container of claim 1 wherein when the lid and base are in sealed engagement, the lid upper portion and the top rim of the vessel contact each other to form a leak resistant seal.

3. The container system of claim 2 wherein:

the vessel is a cup having a floor and a lower sidewall with a cup bottom rim; and the first vessel-receiving mechanism is a ring-shaped trough shaped to receive the cup bottom rim.

4. The container system of claim 2 wherein the lid has one or more vents.

5. The container system of claim 4 wherein at least one of the one or more vents is located on the portion of the lid that is over the vessel when the lid and base are in sealed engagement.

6. The container system of claim 3 wherein the lid has one or more vents.

7. The container system of claim 6 wherein at least one of the one or more vents is located on the portion of the lid that is over the vessel when the lid and base are in sealed engagement.

8. The container system of claim 2 wherein the lid and base are attached via a hinge.

9. The container system of claim 3 wherein the lid and base are attached via a hinge.

10. A plastic food container comprising:

a lid and a base;

the base having a floor, a base sidewall and a base rim formed atop the base sidewall;

the lid having an upper portion, a lid sidewall and a lid rim formed at the end of the lid sidewall;

the lid rim adapted for sealing engagement with the base rim;

the base floor having a first vessel-receiving mechanism formed therein, the first vessel-receiving mechanism being sized and shaped to receive a vessel, the vessel having a bottom and a top rim;

the lid upper portion having a second vessel-receiving mechanism formed therein, the second vessel-receiving mechanism being sized and shaped to receive frictionally engage the top rim of the vessel when such vessel is received by the first vessel-receiving mechanism and when the lid and base are in sealed engagement; and the lid and base further formed such that the vessel is restrained from lateral and vertical movement within the lid and base and the upper portion of the lid exerts downward pressure on the vessel rim when the lid and base are in sealed engagement and the vessel is received by the first vessel-receiving mechanism and frictionally engaged by the second-vessel receiving mechanism.

11. The container of claim 10 wherein when the lid and base are in sealed engagement, the lid upper portion and the top rim of the vessel contact each other to form a leak resistant seal.

12. The container system of claim 11 wherein:

the vessel is a cup having a floor and a lower sidewall with a cup bottom rim; and the first vessel-receiving mechanism is a ring-shaped trough shaped to receive the cup bottom rim.

* * * * *

UNITED STATES PATENT AND TRADEMARK OFFICE

CERTIFICATE OF CORRECTION

PATENT NO. : 8,967,408 B2
APPLICATION NO. : 13/732976
DATED : March 3, 2015
INVENTOR(S) : Michael Tyberghein It is certified that error appears in the above-identified patent and that said Letters Patent is hereby corrected as shown below:

In the Claims

Column 10, line 15, please remove “receive”.

Signed and Sealed this
Twenty-third Day of June, 2015

Michelle K. Lee

Michelle K. Lee
*Director of the United States Patent and Trademark Office*